US006212827B1

(12) United States Patent
Miller

(10) Patent No.: US 6,212,827 B1
(45) Date of Patent: Apr. 10, 2001

(54) SUPPORT ARM

(75) Inventor: Aden Miller, Massillon, OH (US)

(73) Assignee: A. L. Hansen Mfg. Co., Waukegan, IL (US)

( * ) Notice: Subject to any disclaimer, the term of this patent is extended or adjusted under 35 U.S.C. 154(b) by 0 days.

(21) Appl. No.: 09/490,970

(22) Filed: Jan. 24, 2000

Related U.S. Application Data

(63) Continuation of application No. 09/104,515, filed on Jun. 25, 1998, now Pat. No. 6,041,548.

(51) Int. Cl.[7] ..... E05F 11/28
(52) U.S. Cl. ..... 49/345; 49/340; 16/366
(58) Field of Search ..... 49/247, 248, 249, 49/340, 345, 286, 379, 381; 16/365, 366, 370

(56) References Cited

U.S. PATENT DOCUMENTS

| | | | | |
|---|---|---|---|---|
| 3,561,161 | | 2/1971 | Green . | |
| 3,792,556 | | 2/1974 | Anghinetti et al. . | |
| 4,185,415 | | 1/1980 | LaConte . | |
| 4,452,015 | | 6/1984 | Jacques et al. . | |
| 4,735,018 | * | 4/1988 | Duncan et al. | 49/340 |
| 4,765,026 | | 8/1988 | Dochnahl . | |
| 4,899,420 | | 2/1990 | Bye et al. . | |
| 4,936,624 | | 6/1990 | West . | |
| 5,299,722 | | 4/1994 | Cheney . | |
| 5,339,494 | | 8/1994 | Esau et al. . | |
| 5,566,403 | | 10/1996 | Black et al. . | |
| 5,815,984 | * | 10/1998 | Sheets et al. | 49/341 X |

* cited by examiner

*Primary Examiner*—Daniel P. Stodola
*Assistant Examiner*—Hugh B. Thompson
(74) *Attorney, Agent, or Firm*—Brinks Hofer Gilson & Lione

(57) ABSTRACT

A support arm includes first and second links that are interconnected at a pivot. A gas spring is mounted to the first and second links such that the gas spring is disposed between the links and it biases the links to an extended position. The support arm can be used to support the hinged lid for a pickup truck bed.

19 Claims, 2 Drawing Sheets

56
54
10
58
22
52
50

56
54
34
32
30
10
22
58
20
52
50

SUPPORT ARM

This application is a continuation of U.S. application Ser. No. 09/104,515, filed Jun. 25, 1998, now U.S. Pat. No. 6,041,548.

BACKGROUND

The present invention relates to linkages, and more particularly to pivoted linkages suitable for use with biasing elements such as gas struts.

Conventionally, lids or tops such as hoods, trunk lids or large container tops are provided with biasing elements that bias the lid or top to an open position. One such application is that of a lid that covers a pick-up truck bed. It is desirable to provide such a lid with a biasing element that assists the user in lifting the lid from a closed to an open position, and that supports the lid in the open position.

U.S. Pat. No. 5,556,403 discloses a lifting device for a spa cover. The spa cover is hinged along one side, and a gas strut is directly connected between the spa cover at one end and the spa frame at the other.

U.S. Pat. No. 4,452,015 discloses a device for balancing an automobile deck lid. In the disclosed device, a return lever includes two substantially perpendicular arms that are rigidly joined together. A gas strut connected at one end to the return lever and at the other end to the deck lid facilitates the opening and closing of the lid.

U.S. Pat. No. 3,561,161 discloses an automatic door closing device. In the disclosed device first and second pivoted links extend between a door frame and a sliding door. The link that is attached to the sliding door includes an extension that protrudes beyond the other link. A spring is mounted between the end of this extension and a bracket attached to the door frame to bias the sliding door closed.

SUMMARY

The present invention is defined by the following claims, and nothing in this section should be considered to be a limitation on those claims.

By way of introduction, the embodiment described below may be attached between the lid and the enclosed compartment of a truck bed to provide lifting forces tending to open and support the lid. The disclosed linkage includes first and second links that are interconnected at a pivot and are coupled to the lid and the compartment by first and second mounting elements, respectively. A biasing element such as a gas spring is secured to the first link at a first joint and to the second link at a second joint. The first and second joints are disposed on opposite sides of a line extending between the pivot and the second mounting element, and the second joint is disposed on the second link intermediate the pivot and the second mounting element. As described in detail below, by properly selecting the shape of the second link, lifting forces when the lid is closed can be adjusted with respect to lifting forces when the lid is open. Furthermore, the disclosed device is compact, and it allows the use of a relatively compact gas strut.

DETAILED DESCRIPTION OF THE PRESENTLY PREFERRED EMBODIMENTS

Figure 1:
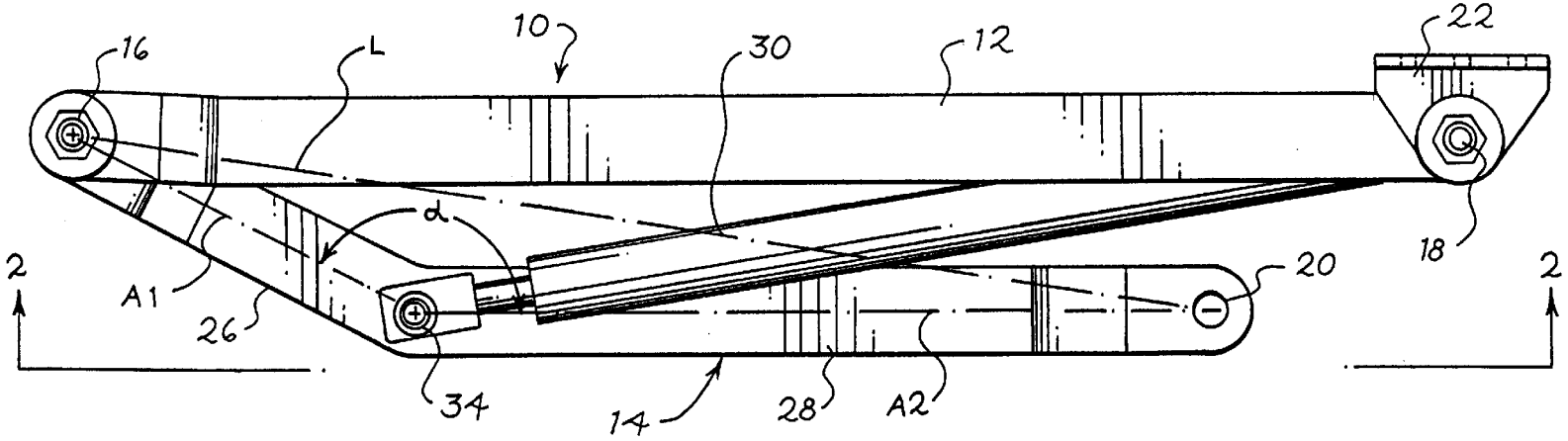
FIG. 1 is a side view of a first preferred embodiment of this invention.
Figure 2:
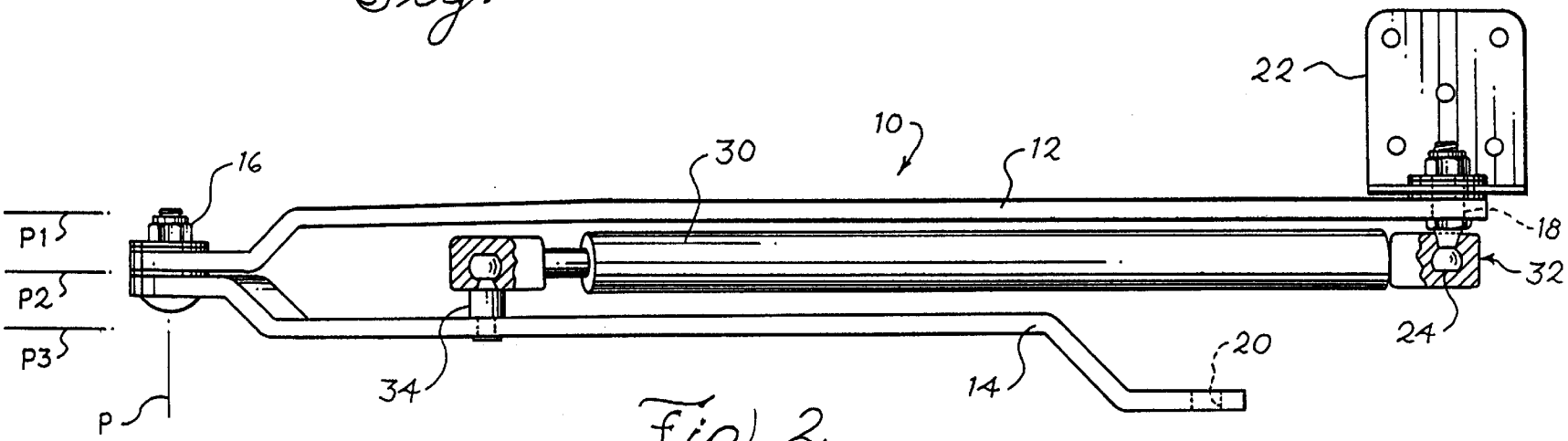
FIG. 2 is a bottom view taken along line 2—2 of FIG. 1.

Turning now to the drawings, FIG. 1 shows a side view of a preferred embodiment of the support arm of this invention. The support arm 10 includes the first and second rigid links 12, 14 that are pivotably interconnected at a pivot 16 such that the links 12, 14 are free to rotate with respect to one another about the pivot axis P as shown in FIG. 2.

A first mounting element 18 is secured to one end of the first link 12, and a second mounting element 20 is secured to one end of the second link 14. The term "mounting element" is intended broadly to encompass any suitable structure for securing the respective link to an adjacent structure. In this embodiment, the first mounting element 18 takes the form of a shaft and the second mounting element takes the form of an opening, though other mounting elements can be used. As best shown in FIG. 2, the first mounting element 18 secures the first link 12 to a mounting bracket 22 such that the first link 12 is free to pivot with respect to the mounting bracket 22 about an axis defined by the first mounting element 18. The first mounting element 18 terminates in a ball 24 as discussed below.

As best shown in FIG. 1, the second link 14 includes a first portion 26 that extends to the pivot 16 and a second portion 28 that extends to the second mounting element 20. The first and second portions 26, 28 meet at the second joint 34 described below.

A biasing element 30 which in this embodiment takes the form of a gas spring is mounted to the first and second links 12, 14 by first and second joints 32, 34, respectively. In this embodiment, the first and second joints 32, 34 are both ball joints, and the first joint 32 includes the ball 24 of the first mounting element 18 described above. The biasing element 30 biases the first and second joints 32, 34 away from one another, and conventional gas springs are suitable. Other biasing elements including extension coil springs can be substituted.

As best shown in FIG. 1, the first portion 26 defines a first axis A1 extending between the pivot access P and the second joint 34. The second portion 28 defines a second axis A2 extending between the second joint 34 and the second mounting element 20. The first and second axes A1, A2 form an obtuse angle $\alpha$ that faces the first link 12. The obtuse angle $\alpha$ is preferably greater than 135° and more preferably about 150°.

Because the axes A1, A2 are angled with respect to one another as shown in FIG. 1, the first and second joints 32, 34 are disposed on opposite sides of a line L extending between the pivot 16 and the second mounting element 20. As shown in FIG. 2, the second joint 34 is positioned at an intermediate point along the length of the second link 14 generally between the pivot 16 and the second mounting element 20.

As best shown in FIG. 2, a portion of the first link 12 is aligned with a first plane P1, a portion of the second link 14 is aligned with a second plane P2, and a portion of the biasing element 30 is aligned with a third plane P3. All three planes, P1, P2, P3 are parallel to one another and perpendicular to the pivot axis P. As shown in FIG. 2, the plane P3 is disposed intermediate the planes P1 and P2. Thus, the biasing element 30 is disposed between the first and second links 12, 14, both in a viewing direction perpendicular to the pivot axis P (FIG. 2) and in a viewing direction parallel to the pivot axis (FIG. 1).

Figures 3, 4:
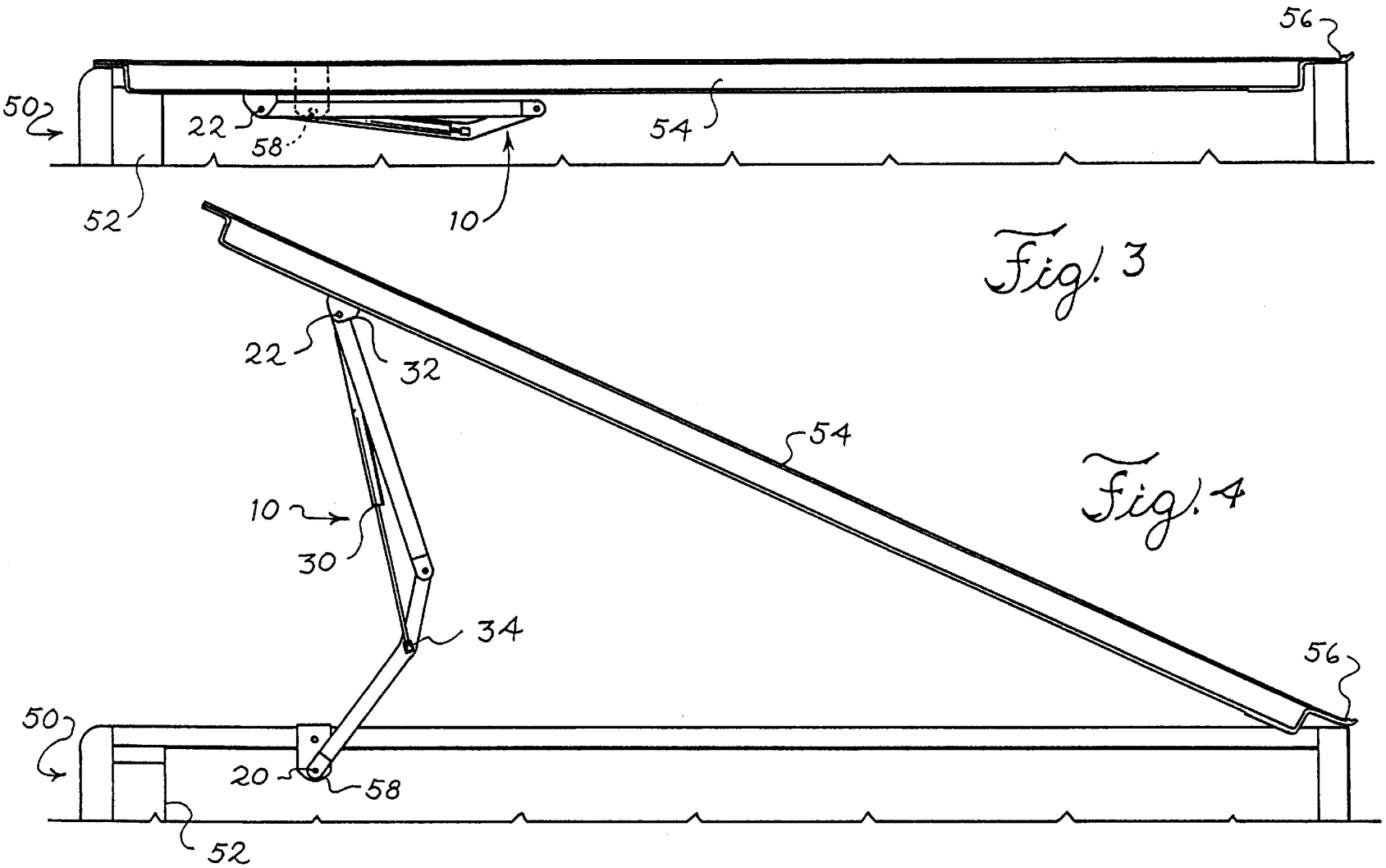
FIG. 3 is a side view of the embodiment of FIGS. 1 and 2 installed on a lid in a closed position.
FIG. 4 is a side view corresponding to FIG. 3, showing the lid in an open position.

As shown in FIGS. 3 and 4, the support arm 10 can be mounted to a pickup truck 50 including a truck bed 52 and a lid 54. In this exemplary application, the lid 54 is pivotably connected to the truck bed 52 at a hinge 56, the mounting bracket 22 is secured to the lid, and the second mounting element 20 is pivotably mounted to the truck bed 52 via a shaft 58. For example, the lid 54 can have a length of six to eight feet. The biasing element 30 provides a biasing force tending to move the first and second joints 32, 34 away from one another, thereby tending to extend the support arm 10 to provide a lifting force tending to rotate the lid 54 about the hinge 56 to an open position.

The support arm 10 provides a number of significant advantages. First, because the biasing element 30 extends between the first and second links 12, 14 rather than between the truck bed 52 and the lid 54, a shorter and therefore less expensive biasing element 30 can be used. Second, the support arm 10 with its pivot 16 provides support for the lid 54 and reduces stress on the hinge 56. Third, the configuration of the second link 14 allows the designer to select the lifting force when the lid is in the closed position for a given lifting force when the lid is in the open position. Because the first and second portions 26, 28 are angled with respect to one another, and because the second joint 34 is positioned on the opposite side of the line L from the first joint 32, the moment arm of the biasing element 30 about the pivot 16 is modified when the lid 54 is in the closed position and the support arm 10 is in the configuration shown in FIG. 3.

As yet another advantage, because the biasing element 30 is positioned between the first and second links 12, 14 in both the viewing direction of FIG. 1 and the viewing direction of FIG. 2, a relatively compact assembly is provided that minimizes the space required for installation. Also, installation of the biasing element 30 on the truck 50 is simplified, because the biasing element 30 can be pre-installed on the links 12, 14, as shown in FIGS. 1 and 2.

Simply by way of example, the following details of construction are provided in order to clarify the best mode of the invention. In this embodiment, the links 12, 14 are formed of stamped steel, for example, having a width of about 1 inch and thickness of about ¼ inch. Conventional nylon washers can be used at the pivot 16 and the first mounting element 18 adjacent the links 12, 14 and the mounting bracket 22. Conventional steel washers can be used adjacent the nuts included in the pivot 16 and adjacent the mounting bracket 22, and these nuts may be conventional 5/16–18, zinc-plated nylon insert lock nuts. The links 12, 14 and the mounting bracket 22 can be coated with any suitable finishing material.

Of course, many changes and modifications can be made to the preferred embodiment described above. For example, this embodiment is not restricted for use with truck bed lids, but can be used for a wide variety of applications where a lifting force is required. The links 12, 14 can be adapted in dimension and shape to fit the intended application, and various biasing elements can be used as described above. The ball joints may be replaced with other types of joints that allow the required movements, and the illustrated threaded fasteners can be replaced with other types of fasteners including riveted fasteners, adhesively secured fasteners, and the like. Of course, the mounting elements and the mounting bracket can be readily adapted as appropriate for the particular application. Materials, finishes, and details of construction such as the use of washers or nuts can all be modified as desired.

It is intended that the foregoing detailed description be regarded as an illustration of a few of the many forms that the present invention can take and not as a definition of the invention. It is only the following claims, including all equivalents, that are intended to define the scope of this invention.

What is claimed is:

1. A support arm comprising:

(a) a first link including a first attachment location and a first mounting element, the first link being pivotable about the first mounting element;

(b) a second link including a second attachment location and a second mounting element, the second link being pivotable about the second mounting element;

(c) a biasing element connecting the first and second links at the respective first and second attachment locations;

the first and second links being pivotably interconnected at a pivot having a pivot axis;

the first and second links including first and second surfaces respectively, the first and second surfaces oriented non-parallel to the pivot axis and facing each other;

the first attachment location being on the first surface of the first link and the second attachment location being on the second surface of the second link; the second attachment location being located along the second link between the pivot and the second mounting element;

the first and second links forming first and second angles from a viewing direction parallel to the pivot axis, the first angle being formed between the first mounting element, the pivot, and the second mounting element, the second angle being formed between the first mounting element, the pivot, and the second attachment location, the second angle being wider than the first angle.

2. The support arm of claim 1 wherein the first attachment location is co-located with the first mounting element.

3. The support arm of claim 1 wherein the second angle is at least 10 degrees wider than the first angle.

4. The support arm of claim 1 wherein the first mounting element consists of a mounting element selected from the group consisting of: an aperture, a shaft, and a ball joint.

5. The support arm of claim 1 wherein the second mounting element consists of an element selected from the group consisting of: an aperture, a shaft, and a ball joint.

6. The support arm of claim 1 wherein the pivot is located at respective first ends of the first and second links, and the first and second mounting elements are positioned at respective second ends of the first and second links.

7. The support arm of claim 1 wherein a substantial portion of the biasing element is located between substantial portions of the first and second links in a viewing direction perpendicular to the pivot axis.

8. The support arm of claim 1 wherein the biasing element biases the first and second attachment locations apart.

9. The support arm of claim 1 wherein the biasing element is connected with the first and second links with ball joints.

10. The support arm of claim 1 wherein the biasing element includes a gas strut.

11. A support arm system comprising:

(a) a support arm including;

a first link including a first attachment location and a first mounting element, the first link being pivotable about the first mounting element;

a second link including a second attachment location and a second mounting element, the second link being pivotable about the second mounting element;

a biasing element connecting the first and second links at the respective first and second attachment locations;

the first and second links being pivotable interconnected at a pivot, the pivot having a pivot axis;

the first attachment location being located on a surface of the first link facing the second link and the second attachment location being located on a surface of the second link facing the first link; the second attachment location being located along the second link between the pivot and the second mounting element;

the first and second links forming first and second angles from a viewing direction parallel to the pivot axis, the first angle being formed between the first mounting element, the pivot, and the second mounting element, the second angle being formed between the first mounting element, the pivot, and the second attachment location, the second angle being greater than the first angle;

(b) a lid hinged with an adjacent structure, one of said first and second mounting elements being coupled to the lid and the other mounting element coupled to the adjacent structure.

12. The support arm system of claim 11 wherein the first attachment location is co-located with the first mounting element.

13. The support arm system of claim 11 wherein the second angle is at least 10 degrees wider than the first angle.

14. The support arm system of claim 11 wherein the first and second mounting elements each consist of a mounting element selected from the group consisting of: an aperture, a shaft, and a ball joint.

15. The support arm system of claim 11 wherein the pivot is located at respective first ends of the first and second links, and the first and second mounting elements are positioned at respective second ends of the first and second links.

16. The support arm system of claim 11 wherein a substantial portion of the biasing element is located between substantial portions of the first and second links in a viewing direction perpendicular to the pivot axis.

17. The support arm system of claim 11 wherein the biasing element biases the first and second attachment locations apart.

18. The support arm of claim 11 wherein the biasing element is connected with the first and second links via ball joints.

19. A support arm adapted for biasing open a lid comprising:

(a) a first link including a first attachment location and a first mounting element, the first link being pivotable about the first mounting element;

(b) a second link including a second attachment location and a second mounting element, the second link being pivotable about the second mounting element;

(c) a biasing element connecting the first and second links at the respective first and second attachment locations, the biasing element biasing the first and second attachment locations apart;

the first and second links being pivotable interconnected at a pivot having a pivot axis;

the first attachment location being on a surface of the first link facing the second link and the second attachment location being on a surface of the second link facing the first link;

the second attachment location being located along the second link between the pivot and the second mounting element;

the first and second links forming first and second angles from a viewing direction parallel to the pivot axis, the first angle being formed between the first mounting element, the pivot, and the second mounting element, the second angle being formed between the first mounting element, the pivot, and the second attachment location, the second angle being greater than the first angle.

* * * * *